US008966856B2

(12) United States Patent
Groenesteyn

(10) Patent No.: US 8,966,856 B2
(45) Date of Patent: Mar. 3, 2015

(54) STRUCTURAL REINFORCEMENT

(75) Inventor: Anthony T. Groenesteyn, Kelowna (CA)

(73) Assignee: Int'l Structure Lock Systems Inc., Kelowna (CA)

( * ) Notice: Subject to any disclaimer, the term of this patent is extended or adjusted under 35 U.S.C. 154(b) by 0 days.

(21) Appl. No.: 13/318,336

(22) PCT Filed: Nov. 13, 2009

(86) PCT No.: PCT/CA2009/001619

§ 371 (c)(1),
(2), (4) Date: Oct. 31, 2011

(87) PCT Pub. No.: WO2011/057377

PCT Pub. Date: May 19, 2011

(65) Prior Publication Data

US 2012/0272608 A1 Nov. 1, 2012

(51) Int. Cl.

| | |
|---|---|
| ***E04C 3/30*** | (2006.01) |
| ***E04C 5/18*** | (2006.01) |
| ***E04C 3/18*** | (2006.01) |
| *E04H 9/02* | (2006.01) |

(52) U.S. Cl.
CPC ... *E04C 5/18* (2013.01); *E04C 3/18* (2013.01); *E04H 9/028* (2013.01)
USPC ..... 52/657; 52/643; 52/655.1; 52/693; 52/695

(58) Field of Classification Search
USPC ..... 52/643, 655.1, 657, 677, 690, 693, 695, 52/696, 712
See application file for complete search history.

(56) References Cited

U.S. PATENT DOCUMENTS

| | | | | |
|---|---|---|---|---|
| 457,664 | A | 8/1891 | Paine | |
| 1,106,845 | A | 7/1913 | Ream | |
| 1,558,239 | A * | 10/1925 | Costello | 52/46 |
| 1,574,329 | A | 2/1926 | White | |
| 1,642,945 | A | 10/1926 | Davidson | |
| 1,649,226 | A | 11/1927 | Gstalder | |
| 1,657,243 | A | 1/1928 | Daniels | |
| 1,656,741 | A | 8/1928 | Lane | |
| 1,729,741 | A * | 10/1929 | Heltzel | 52/695 |
| 1,822,332 | A | 9/1930 | Bates, Jr. | |

(Continued)

FOREIGN PATENT DOCUMENTS

| | | |
|---|---|---|
| GB | 2436334 | 9/2007 |
| WO | WO 2009/094303 A2 | 7/2009 |

*Primary Examiner* — Charles A Fox
*Assistant Examiner* — Patrick Maestri
(74) *Attorney, Agent, or Firm* — Richard D. Okimaw

(57) ABSTRACT

Disclosed is an apparatus and method for reinforcing adjacent parallel spaced apart wooden structural members wherein each of the structural members has opposed first and second edges. The apparatus comprises a rigid member being sized to extend between the first edge of a first structural member and the second edge of an adjacent second structural member. The apparatus further comprising first and second sockets connected to first and second ends of the rigid member each sized to receive and edge of one of the structural members therein. The method comprises engaging the first socket around the first edge of the first structural member and locating a second structural member with the second edge of the second structural member within a second socket. The method may also comprise rotating the rigid member between the first and second structural members until the first and second sockets are engaged around diagonally opposed edges the structural members.

16 Claims, 9 Drawing Sheets

(56) References Cited

U.S. PATENT DOCUMENTS

| | | | | |
|---|---|---|---|---|
| 1,867,449 | A | 7/1932 | Eckert | |
| 1,934,708 | A | 11/1933 | Hatch | |
| 2,110,863 | A | 3/1938 | Barnett | |
| 2,191,979 | A | 2/1940 | Bierbach | |
| 2,369,525 | A | 2/1945 | Blaski | |
| 2,565,875 | A * | 8/1951 | Musacchia | 52/695 |
| 1,145,385 | A | 7/1957 | Marble | |
| 2,865,059 | A | 12/1958 | Scriven | |
| 2,911,690 | A | 11/1959 | Sanford | |
| 2,964,807 | A | 12/1960 | Kennedy | |
| 3,049,764 | A | 8/1962 | Kawalle | |
| 3,184,800 | A | 5/1965 | Nelson | |
| 3,422,585 | A | 1/1969 | Dismukes | |
| 3,423,898 | A | 1/1969 | Tracy et al. | |
| 3,708,942 | A | 1/1973 | Leonard | |
| 3,727,358 | A | 4/1973 | Howell | |
| 3,959,945 | A | 6/1976 | Allen | |
| 4,077,176 | A | 3/1978 | Bauer | |
| 4,143,500 | A | 3/1979 | Sanford | |
| 4,160,350 | A | 7/1979 | Craib | |
| 4,189,247 | A | 2/1980 | Burwall | |
| 4,192,118 | A | 3/1980 | Gilb | |
| 4,230,416 | A | 10/1980 | Gilb | |
| 4,246,736 | A | 1/1981 | Kovar et al. | |
| 4,332,501 | A | 6/1982 | Slysh | |
| 4,382,710 | A | 5/1983 | Slowbe | |
| 4,414,785 | A | 11/1983 | Howell | |
| 4,455,805 | A | 6/1984 | Rionda et al. | |
| 4,561,230 | A | 12/1985 | Rionda et al. | |
| 4,604,845 | A | 8/1986 | Brinker | |
| 4,637,195 | A | 1/1987 | Davis | |
| 4,843,726 | A | 7/1989 | Ward | |
| 4,910,934 | A | 3/1990 | Hennings | |
| RE34,022 | E | 8/1992 | Davis | |
| 5,197,818 | A | 3/1993 | Johnson | |
| 5,307,603 | A | 5/1994 | Chiodo | |
| 5,375,384 | A | 12/1994 | Wolfson | |
| 5,412,920 | A | 5/1995 | Hess | |
| 5,448,871 | A | 9/1995 | Newman et al. | |
| 5,467,570 | A | 11/1995 | Leek | |
| 5,603,580 | A | 2/1997 | Leek et al. | |
| 5,606,837 | A | 3/1997 | Holizlander | |
| 5,653,079 | A | 8/1997 | Loeffler et al. | |
| 5,697,725 | A | 12/1997 | Ballash et al. | |
| 5,732,524 | A | 3/1998 | Kalker | |
| 5,836,131 | A | 11/1998 | Viola et al. | |
| 5,867,962 | A | 2/1999 | Scott et al. | |
| 5,899,042 | A | 5/1999 | Pellock | |
| 5,937,608 | A | 8/1999 | Kucirka | |
| 5,996,303 | A | 12/1999 | Pellock | |
| 6,003,280 | A | 12/1999 | Wells | |
| 6,170,218 | B1 | 1/2001 | Shahnazarian | |
| 6,354,055 | B1 | 3/2002 | Shaw et al. | |
| 6,418,695 | B1 | 7/2002 | Daudet et al. | |
| 6,758,022 | B1 | 7/2004 | Coll et al. | |
| 6,837,019 | B2 | 1/2005 | Collie | |
| 6,993,882 | B2 | 2/2006 | Crawford et al. | |
| 7,090,174 | B2 | 8/2006 | Korczak et al. | |
| 7,454,872 | B2 | 11/2008 | Cutforth | |
| D607,711 | S | 1/2010 | Adams et al. | |
| 7,885,867 | B2 | 2/2011 | Krystek et al. | |
| 8,302,360 | B2 | 11/2012 | Legnini | |
| 2005/0224667 | A1 | 10/2005 | Whale et al. | |
| 2009/0151294 | A1 * | 6/2009 | Staley | 52/655.1 |

* cited by examiner

STRUCTURAL REINFORCEMENT

BACKGROUND OF THE INVENTION

1. Field of Invention

The present invention relates to structural reinforcement in general and in particular to reinforcing adjacent wood product structural members to each other.

2. Description of Related Art

In the field of construction, it is often desirable to make a structure as strong as possible. The strength of a building is desirable for the purposes of load bearing ability as well as resistance to outside loads such as earthquakes, wind and other environmental loading.

Building construction typically includes a plurality of elongate members connected each other to form walls, ceilings, floor and the like. In the case of walls, such elongate wall members are often referred to as studs while in ceilings and roofs, they may be referred to as joist.

One difficulty that exists is the tendency of relatively long structural members to loose strength and rigidity as their length increases. This is often required for floor and ceiling joists so as to provide larger rooms unobstructed by supporting walls and columns. Such long joists may commonly be subject to torsional buckling failure. Another difficulty that exists with floor joists is when they are exposed to dynamic environmental loads such as earthquakes, strong winds and the like. Under such loads, the floor joists may rotate axially along their length so as to lay flat instead of upright. The resulting horizontal and vertical deflection of the entire load above such a floor may contribute to an entire building failing or collapsing.

Conventional methods of reinforcing structural members has not been adequate to resolve the above difficulties. Previous attempts have tried to locate bridges or blocks between adjacent joists to distribute point loads located near a single joist to adjacent joists so as to distribute the load between more than one joist. Bridging involves locating a pair of crossed diagonal wooden members between adjacent joist whereas blocking typically includes locating a shortened length of the joist member transversely between the joists. Such attempts have not adequately solved the above difficulties. In particular, blocking or bridging is only able to act as a compressive member between the joists and will have a very limited ability to prevent the joists from moving away from each other.

When the joist members are subjected to torsional loading, the blocking members on one side of the joist are subjected to opposite loads. For example, when a torsional load is applied to the joist along the longitudinal axis of the structural member, the blocking member abutting one side of the top chord of the joist is subjected to a primarily compressive load, and the blocking member abutting opposite side of the top chord is subject to a tensile load. Similarly, for the same torsional load, the bottom chord on the same side of that joist will also be subjected to a tensile load. The compressive load may be conveyed efficiently to the blocking member abutting the top chord through the contacting surfaces of the blocking and the joist chord. However the tensile load on both blocking member on the opposite side of the top chord and on the bottom blocking member is born entirely by the fastening device used. Therefore unless such fasteners are specifically designed to bear tensile loads under repeated loading cycles, this is likely to lead to cause premature failure of the structure when such fasteners, such as a nail or a screw pulls out. Due to the inability of bridging and blocking to effectively handle loads in tension, such reinforcing will not significantly assist in the reinforcing of a structure under cyclical environmental loads such as earthquakes, winds and the like.

SUMMARY OF THE INVENTION

According to a first embodiment of the present invention there is disclosed an apparatus for reinforcing adjacent parallel spaced apart wooden structural members wherein each of the structural members has opposed first and second edges. The apparatus comprises a rigid member having first and second ends and being sized to extend between the first edge of a first structural member and the second edge of an adjacent second structural member. The apparatus further comprising a first socket connected to the first end of the rigid member and a second socket connected to the second end of the rigid member. The first socket is sized to receive the first edge of the first structural member therein and the second socket is sized to receive the second edge of the second structural member therein.

The first and second sockets may comprise channels. The channels may comprise c-shaped channels. The c-shaped channels may extend perpendicularly to a longitudinal axis of the rigid member. The c-shaped channels may have vertically oriented openings. The openings of the c-shaped channels may be in opposite directions to each other. The openings of the c-shaped channels may be angularly oriented relative to the rigid member.

The c-shaped channel may be formed of a pair of opposed flanges and a web portion therebetween. One of the pair of opposed flanges may be secured to the rigid member. The other of the pair of opposed flanges may be selectably deformable so as to open the c-shaped channel. The c-shaped channels may include at least one fastener bore, sized to pass a fastener therethrough so as to secure the c-shaped channel to the structural member.

The first and second sockets may be rigidly affixed to the rigid member. The first and second sockets may be integrally formed with the rigid member. The rigid member and the first and second caps may be formed of metal. The rigid member may comprise an elongate beam. The beam may be selected from the group consisting of a tube, a box section, an I-beam, a c-shaped channel, an L-shaped channel and a triangular cross section beam.

The apparatus may further comprise a pair of intersecting rigid member each sized to extend between top and bottom edges of opposed parallel structural members. Each of the rigid members may have a first socket sized to receive a top edge of one of the pair structural members therein and a second socket sized to receive a bottom edge of the other of the pair of structural members therein. The pair of intersecting rigid members may be pivotally connected to each other. The pair of intersecting rigid members may be pivotally connected to each other by a bolt.

According to a further embodiment of the present invention there is disclosed a method for reinforcing adjacent parallel spaced apart wooden structural members wherein each of the structural members having opposed first and second edges. The method comprises locating a first structural member in a desired position and engaging the first socket of a reinforcing device around the first edge of the first structural member. The method further comprises locating a second structural member in a desired position with the second edge of the second structural member within a second socket of the reinforcing device wherein the reinforcing member has a rigid member extending between the first and second sockets.

According to a further embodiment of the present invention there is disclosed a method for reinforcing adjacent parallel spaced apart wooden structural members wherein each of the structural members have opposed first and second edges. The method comprises locating a first structural member in a desired position, and locating a second structural member in a desired position. The method further comprises rotating a reinforcing device between the first and second structural members until a first socket at a first end of the reinforcing device is engaged around a second edge of the first structural member and a second socket at a second end of the reinforcing device is engaged around a first edge of the second structural member. The reinforcing device has a rigid ember extending between the first and second sockets.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
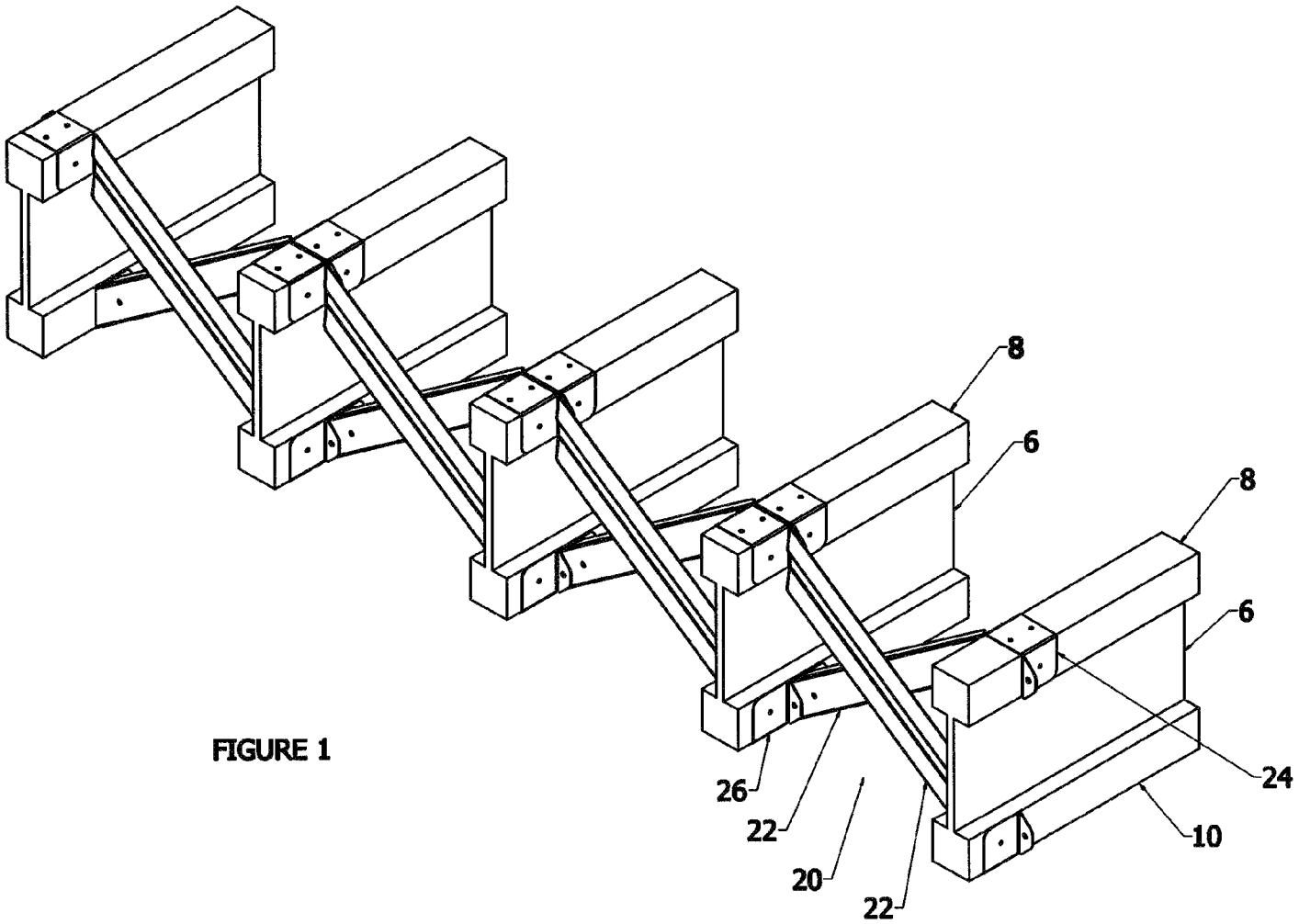
FIG. 1 is a perspective view of a plurality of apparatus' according to a first embodiment of the present invention applied between a plurality of adjacent joists.
Figure 2:
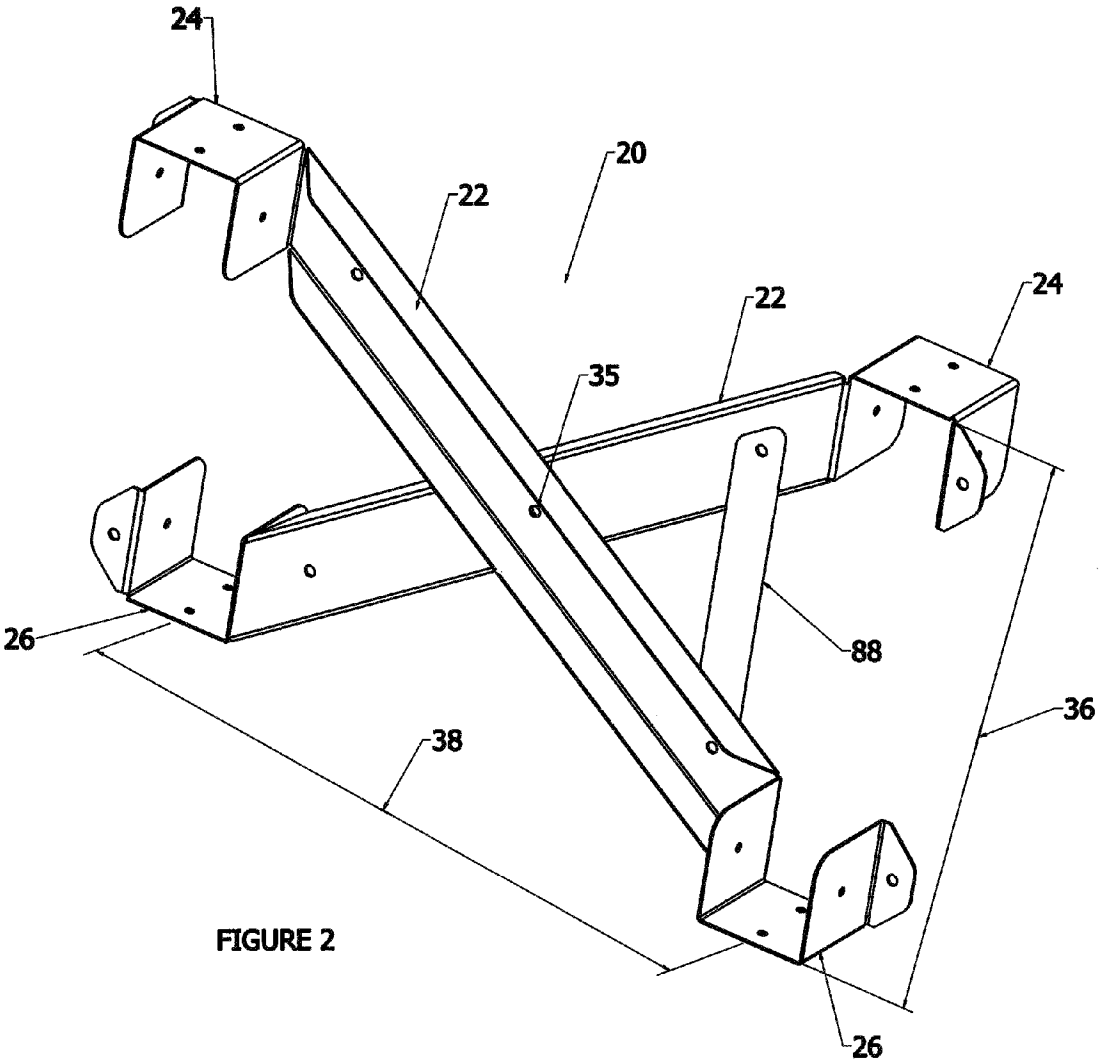
FIG. 2 is a perspective view of the apparatus of FIG. 1.

Referring to FIGS. 1 and 2, an apparatus for stabilizing adjacent structural members 6 according to a first embodiment of the invention is shown generally at 20. The apparatus 20 comprises a pair of intersecting rigid members 22 each spanning between a top edge 8 of one structural member and a bottom edge 10 of an adjacent structural member. Each rigid member includes a first or top socket 24 sized to receive the top edge 8 of the structural member and a second or bottom socket 26 sized to receive the bottom edge 10 of the structural member. Each set of a rigid member 22, top socket 24 and bottom socket 26 comprises a single structural reinforcing device 28. As illustrated in FIG. 1, the top socket 24 of one rigid member 22 and the bottom socket 26 of its corresponding pair cooperate together to retain the structural member therebetween. The apparatus 20 may optionally include a tensile member 88 spanning corresponding top and bottom sockets 24 and 26 so as to retain the sockets at a minimum distance from each other.

It will be appreciated that such a tensile member 88 will serve to retain the top and bottom sockets 24 and 26 in engagement on the structural member. The tensile member 88 may be formed of a rigid or resilient flexible members such as, metal straps, bars, chain and the like, by way of non-limiting example.

Figure 3:
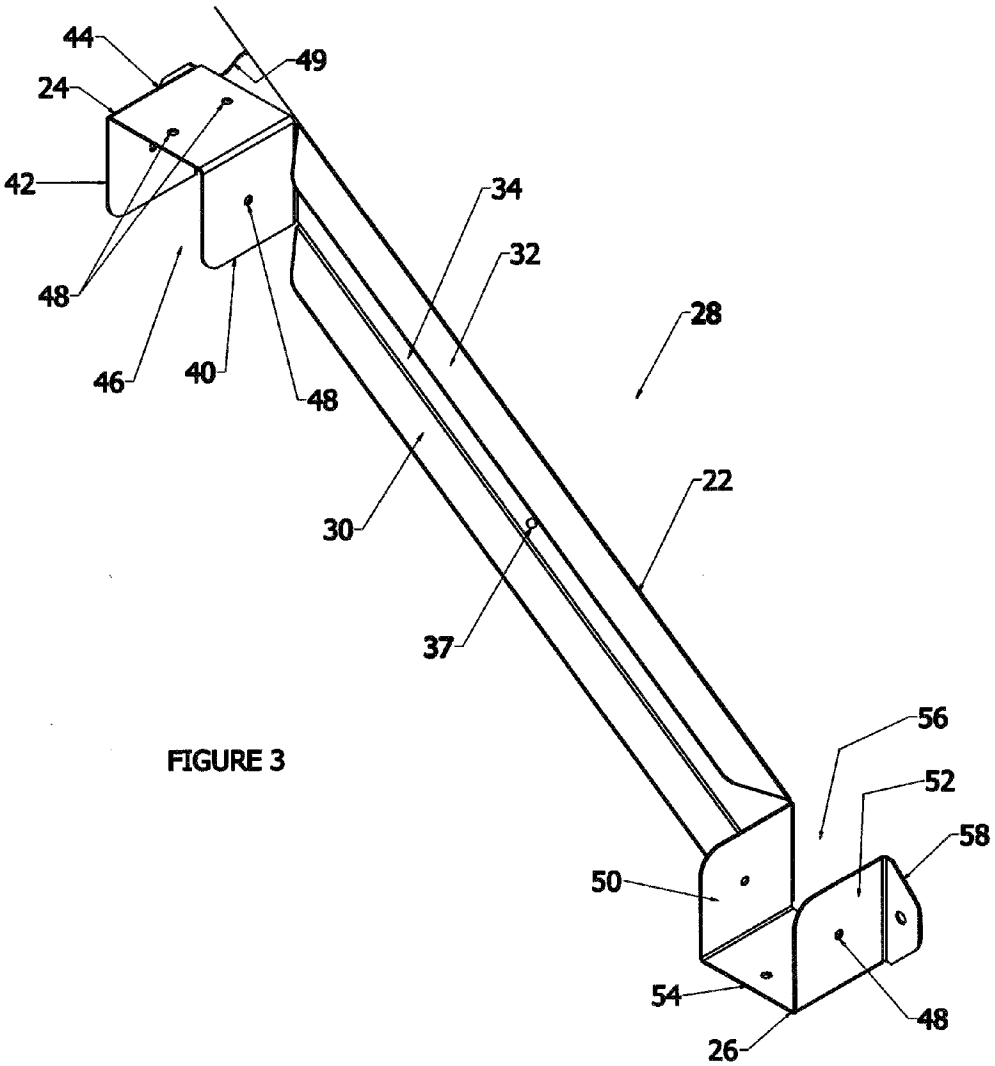
FIG. 3 is a perspective view of one arm of the apparatus of FIG. 2.

Turning now to FIG. 3, a single reinforcing device 28 is illustrated according to a first embodiment of the present invention. The rigid member 22 of the reinforcing device 28 illustrated in FIG. 3 may be formed of sheet metal bent into a c-shaped channel having a pair of sides 30 and 32 and a central web portion 34 therebetween. The sides 30 and 32 may be bent to the same or opposite sides of the web portion 34 however it will be appreciated that where two reinforcing devices 28 are desired to be utilized together as illustrated in FIGS. 1 and 2, it will be preferable to bend both sides 30 and 32 to the same side of the web portion 34. It will also be appreciated that although the rigid member 22 illustrated in FIG. 3 may be formed of bent sheet metal, it may also be formed by other means such as an extruded, cast or welded structure. It will also be appreciated that one or both of the sides 30 or 32 may be omitted depending on the strength requirements of the application. The central web portion 34 includes a bore 37 therethrough so as to permit a pair of reinforcing devices 28 to be pivotally secured to each other by a bolt 35 or the like.

The top socket 24 may comprise an open c-shaped channel formed of first and second top side flanges 40 and 42, respectively and a top web portion 44 forming a channel opening 46. The top channel opening 46 is sized and shaped to correspond to the top edge 8 of the structural member. The bottom socket 26 may comprise an open c-shaped channel formed of first and second bottom side flanges 50 and 52, respectively and a bottom web portion 54 forming a channel opening 56. The bottom channel opening 56 is sized and shaped to correspond to the bottom edge 10 of the structural member. In many applications, the structural member 6 will comprise a floor joist, such as by way of non-limiting example dimensioned lumber or I-joists. Dimensioned lumber is commonly of a 1.5 inch width and therefore for such applications the top and bottom channel openings 46 and 56 will be sized to have a similar width opening. It will be appreciated that other thicknesses of structural members in general and joist sin particular may also be utilized. In some applications, the top and bottom channel openings 46 and 56 may be sized slightly larger than the width of the joist so as to facilitate installation. In particular, the top and bottom channel openings 46 and 56 may be up to 3.2 mm (⅛ of an inch) larger than the joist for which they are designed. The sizing of the top and bottom channel openings 46 and 56 for I-joists may be similarly selected to correspond to the I-joist to be used.

The top and bottom sockets 24 and 26 may include one or more fastener bores 48 located in any one or more of the flanges or webs forming the socket. The fastener bores 48 are sized to permit nails, screws or other suitable fasteners to be passed therethrough so as to secure the top or bottom socket 24 or 26 to the structural member 6. Optionally, the top and bottom sockets 24 and 26 may include barbs, spikes or other suitable projections from an interior surface thereof so as to engage the joist when the reinforcing device 28 is secured thereto. Adhesives may also be applied between the top and bottom edges 8 and 10 of the structural member and the top and bottom sockets 24 and 26. The top and bottom sockets 24 and 26 may also include an optional connecting tab 58 for fastening adjacent top and bottom sockets to each other with fasteners and the like.

As discussed above, the rigid member 22 is sized to extend between a top edge 8 of one structural member 6 and a bottom edge 10 of an adjacent structural member. In practice, the length of the rigid member 22 will depend upon both the height of the structural members and the spacing distance between them. As illustrated in FIG. 2, the height of the structural members 6 will correspond to the distance between the top web portion 44 and the bottom web portion 54 generally indicated at 36. Correspondingly, the distance between the structural members, which is commonly expressed in centre to centre distance will correspond to the distance to the centres of the two top or bottom web portions 44 and 54 generally indicated at 38. It will also be appreciated that the distance between a first top side flanges 40 the second top side flange 42 of a paired reinforcing device 28. Similar spacing distances will apply for the other side flanges of the sets of reinforcing devices 28 so as to maintain the centre to centre spacing of the adjacent structural members 6. By way of example, for a floor constructed of 302 mm (11⅞ inches) high joists spaced 406 mm (16 inches) apart, the width 38 of the apparatus 20 would similarly be 406 mm (16 inches) and the height 36 of the apparatus 20 would be 302 mm (11⅞ inches). It will be appreciated that other heights and widths will apply for joists of differing heights and spacing.

Figure 9:
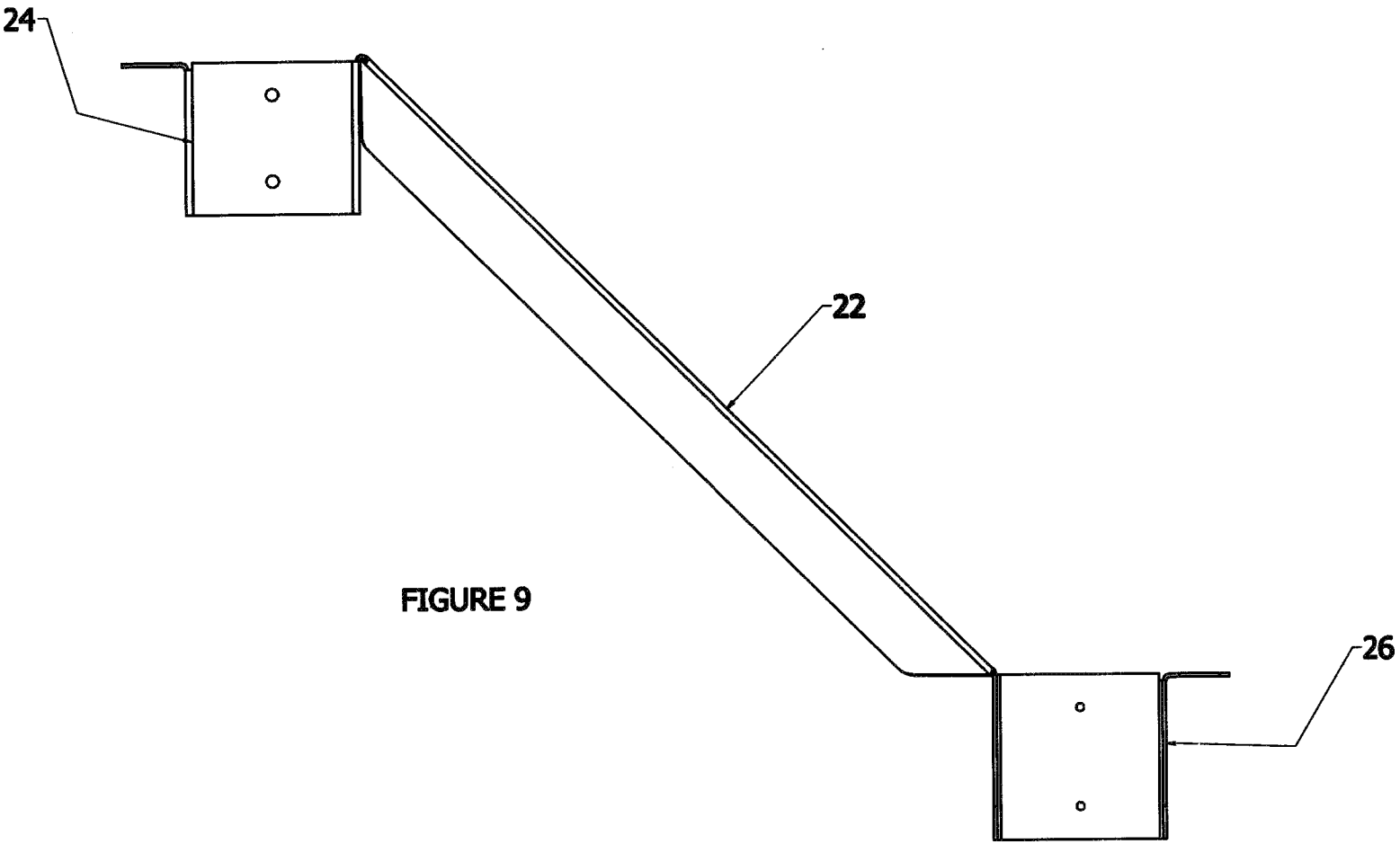
FIG. 9 is a top plan view of the reinforcing member of FIG. 3 having angularly oriented top and bottom caps according to a further embodiment of the present invention.

As illustrated in FIG. 3, the top web portion 44 of the top socket 24 may be angularly aligned relative to the rigid member about a horizontal axis by an angle generally indicated at 49. It will be appreciated that the angle 49 will permit the top web portion 44 to be angularly aligned with the top edge 8 of the structural member 6 while permitting the rigid member 22 to be angularly aligned thereto. The bottom web portion 54 of the bottom socket 26 will have a similar corresponding angle. The top and bottom sockets 24 may also be angularly oriented relative to the rigid member about a vertical axis as illustrated in FIG. 9. It will be appreciated that such arrangement will permit the rigid member to span adjacent joists at a non-perpendicular angel so as to permit the rigid member to avoid obstructions and the like as well as to permit a series of rigid members to extend diagonally across a floor.

Figure 4:
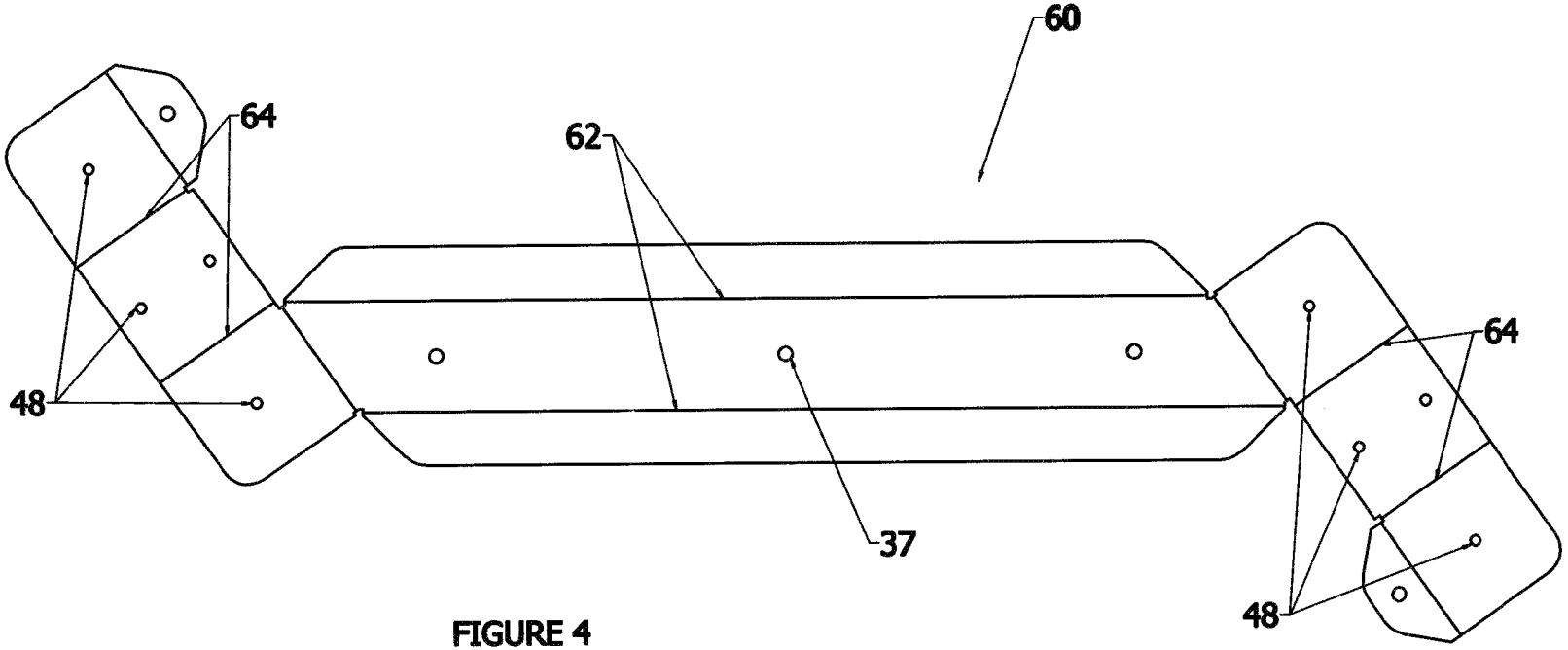
FIG. 4 is a plan view of a cut-sheet to be utilized to form one arm of the apparatus of FIG. 2.

Turning to FIG. 4, a cut sheet is illustrated for forming the reinforcing device 28 of FIG. 3. As illustrated the reinforcing device may be cut from a single sheet of metal, such as, by way of non-limiting example, steel, stainless steel, aluminium or galvanized steel. The sheet metal may be cut into a blank 60. The blank may thereafter be bent along rigid member bend lines 62 to form the rigid member 22 and socket bend lines 64 so as to form the top and bottom sockets 24 and 26 according to known methods. Any thickness of metal as required to provide the necessary strength may be utilized such as between 12 and 22 gauge. In particular, it has been found that sheet metal of between 16 and 20 gauge has been useful. It will also be appreciated that the reinforcing device 28 may also be formed of non-metal materials, such as, by way of non-limiting example, carbon fibre, fibreglass, plastics, ceramics and composite materials.

Figure 5:
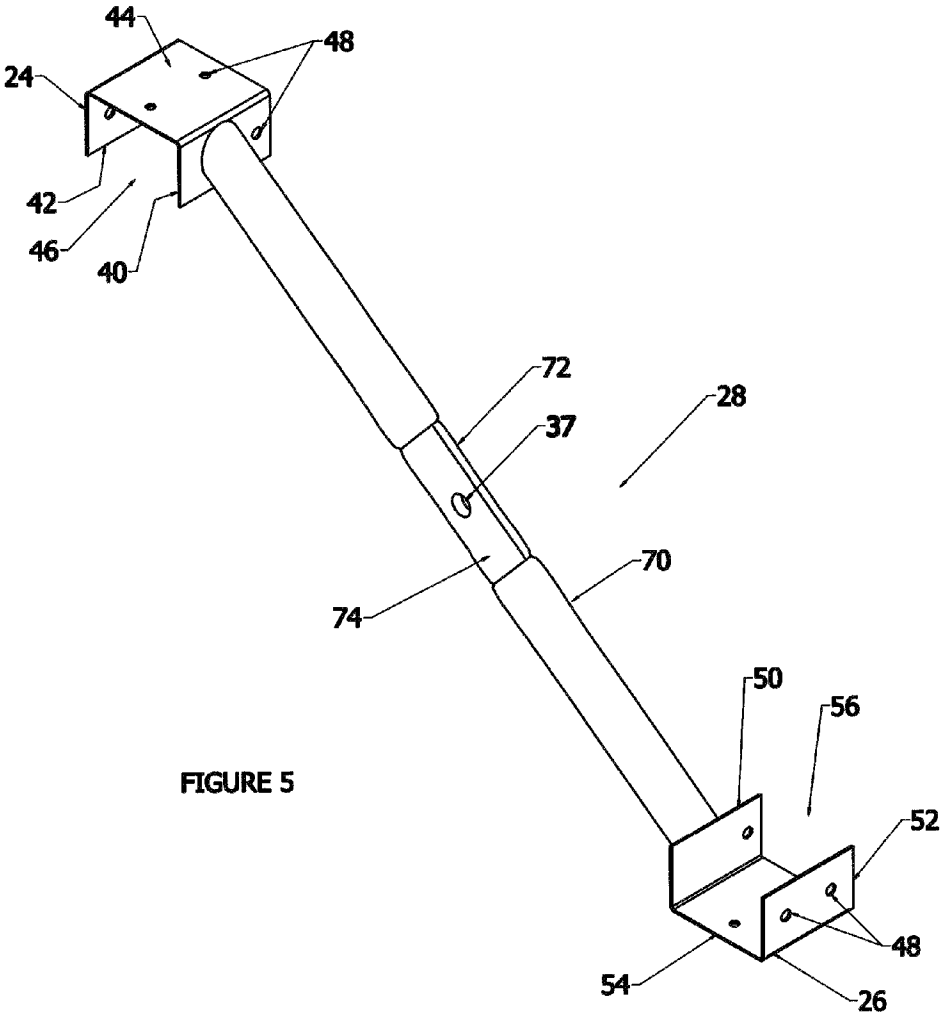
FIG. 5 is a perspective view of one arm of the apparatus of FIG. 2 according to a further embodiment of the present invention.
Figure 6:
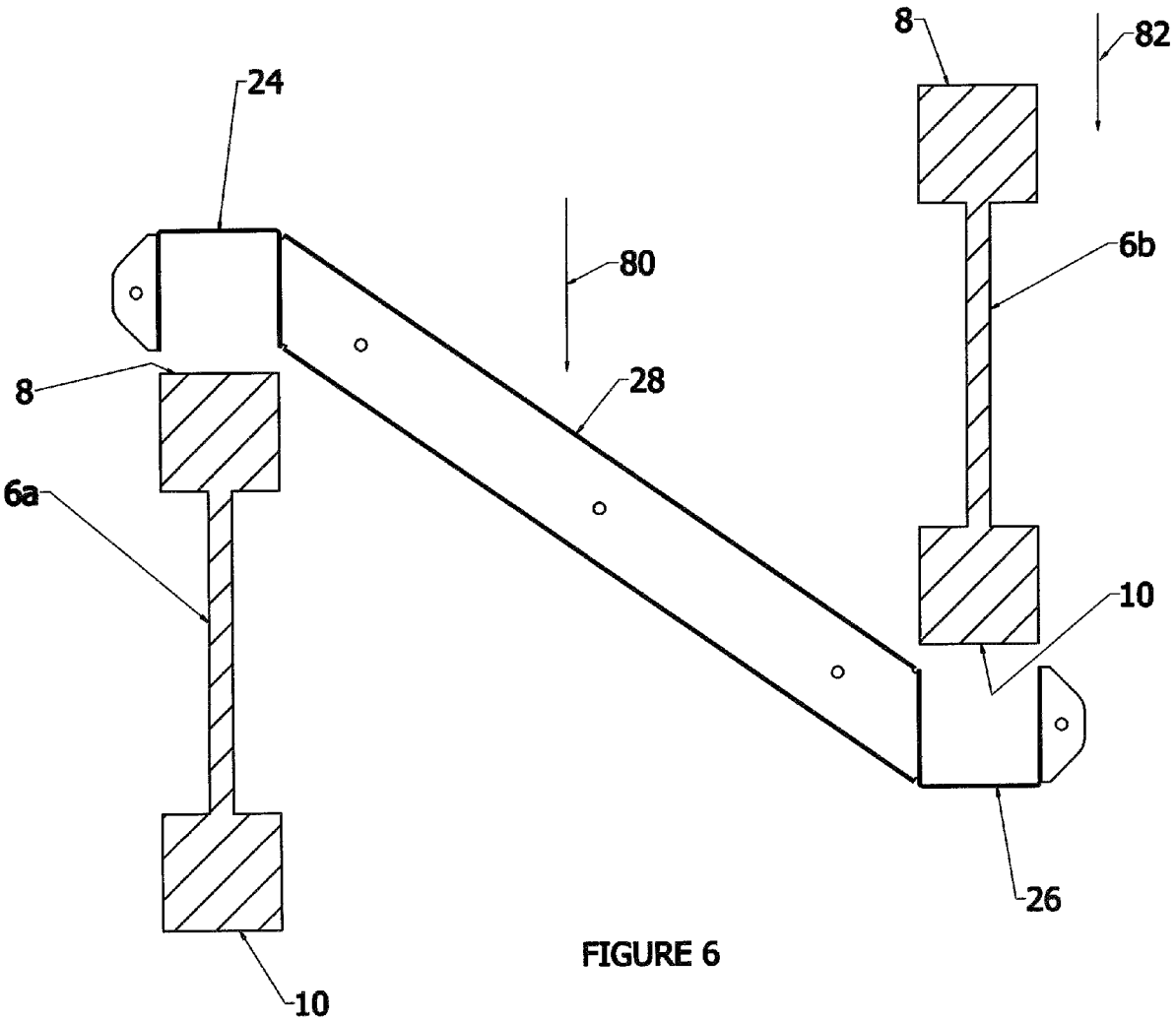
FIG. 6 is a cross-sectional view of a floor construction utilizing a reinforcing member of FIG. 3 being applied to a first joist and subsequently a second joist being secured to the reinforcing member.

Turning to FIG. 5, an alternative embodiment of the present invention is illustrated having a central beam 70 spanning between the first and second sockets 24 and 26. The first and second sockets 24 and 26 may be as described above and may be secured to the beam by welding, bolting or by being integrally formed with the beam 70 by casting or any other suitable means. The beam 70 may comprise any suitable structural member such as, by way of non-limiting example, bar, tube, box section, I-beam, c-shaped channel, L-shaped channel, a triangular cross section beam, or any other suitable member. It will also be appreciated that although elongate, substantially straight members are shown, non-straight members may also be utilized, such as, by way of non-limiting example, arcuate, space frame, plates or any other shape as long as the top and bottom sockets 24 and 26 are rigidly translationally fixed relative to each other so as to securely locate a top edge 8 of one structural member relative to a bottom edge 10 of an adjacent structural member.

The beam 70 may include a central portion 72 having a flat surface 74 therein having a bore 37. The flat surface is vertically oriented such that a corresponding flat surface 74 of a matching reinforcing device 28 may be mated therewith so as to align matching bores 37 for connection with a bolt 35 or the like. Although a bolt is described as being utilized to rotationally secure the pair of reinforcement devices to each other, it will be appreciated that other pivotal means may also be utilized, such as hinges, clamps, rivets and bearings. The flat surface 74 may be formed in the beam 70 by casting or welding of a flat section into the beam or by clamping the central portion 72 of the beam 70 in a machine press or the like. It will also be appreciated that some beam types will already include an adequate flat surface and will not require additional processing.

In operation, a first structural member **6*a* may be located at a desired location. Thereafter a reinforcing device 28 may be located on the first structural member 6*a* by moving the reinforcing device 28 in a downward direction as indicated generally at 80 such that the top edge 8 of the first structural member is retained within the top socket 24 of the reinforcing device. A second structural member 6*b* may then be located such that its bottom edge 10 is retained within the bottom socket 26 by moving the second structural member 6*b* in a downward direction generally indicated at 82. Thereafter, subsequent reinforcing devices 28 and structural members 6 may be placed in succession to provide a single row of reinforcing devices. Fasteners may also be passed through the fastener bores 48 so as to secure the reinforcing devices 28** thereto.

Figure 7:
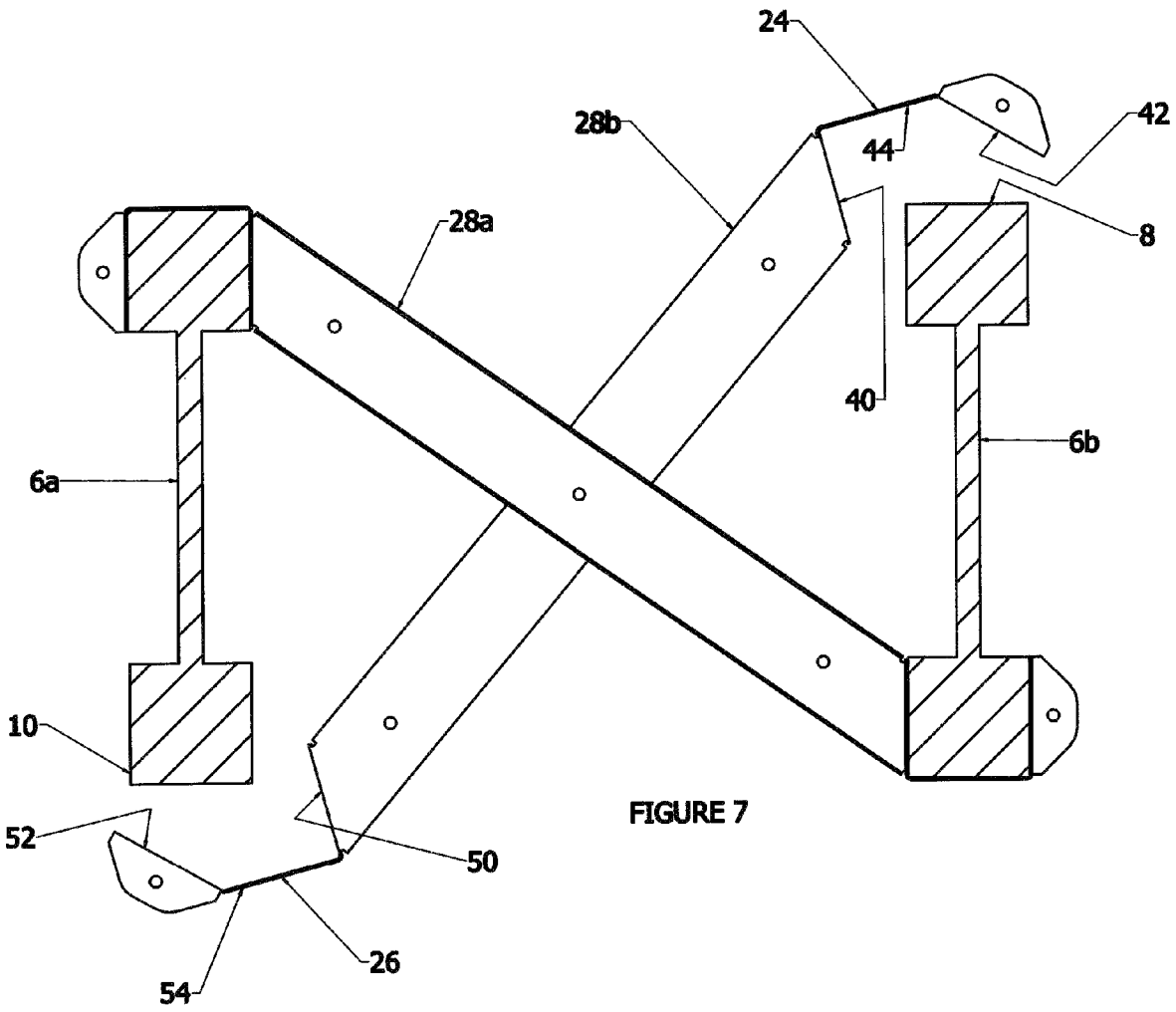
FIG. 7 is a cross-sectional view of a floor construction applying a second reinforcing member between adjacent joists.

Turning to FIG. 7, a second reinforcing device **28*b* may be located between the first and second structural members 6*a* and 6*b* by pivotally located the second reinforcing device 28*b* to the first reinforcing device 28. Thereafter the second reinforcing member 28*b* may be rotated such that the top socket 24 engages with the top edge 8 of the second structural member 6*b* and the bottom socket 26 engages with the bottom edge 10 of the first structural member 6*a*. As illustrated, the second top side flange 42 of the top socket and the second bottom side flange 52 of the bottom socket 26 may be bent outwards to facilitate the rotation of the first and second sockets 24 and 26** into engagement with the top and bottom edges of the structural members. Thereafter, these side flanges may be bent back into position to engage their respective edge of the structural member.

Figure 8:
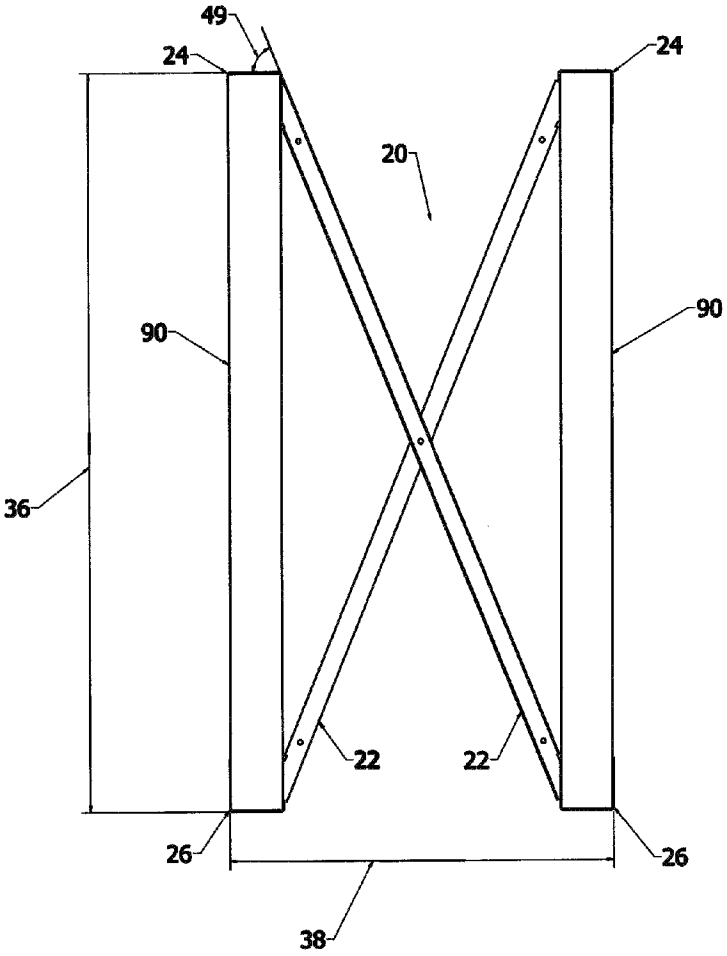
FIG. 8 is a cross-sectional view of an apparatus according to a further embodiment of the present invention being applied between adjacent wall studs.

Although the description above is in reference to floor joists, it will be appreciated that the apparatus 20 may also be applicable to other structural members as well. Turning to FIG. 8, a further embodiment of the present invention is illustrated as applied to adjacent wall studs 90. It will be appreciated that for use in such applications it will be necessary to increase the length of the rigid member 22 and increase the angel 49. Thicker materials may also be required depending upon the strength requirements of the application.

While specific embodiments of the invention have been described and illustrated, such embodiments should be considered illustrative of the invention only and not as limiting the invention as construed in accordance with the accompanying claims.

What is claimed is:

1. An apparatus for reinforcing adjacent parallel spaced apart wooden structural members, each of said structural members having opposed first and second edges, the apparatus comprising:

a rigid member having first and second ends and being sized to extend between the first edge of a first structural member and the second edge of an adjacent second structural member, said rigid member having a web portion extending along a upright plane;

a first socket comprising downward opening c-shaped channels formed of a pair of opposed flanges and a web portion therebetween wherein said web portion of said rigid member is connected to and extends from a upright side edge of one of said flanges of said first socket, said first socket being sized to receive said first edge of said first structural member therein; and a second socket comprising downward opening c-shaped channels formed of a pair of opposed flanges and a web portion therebetween wherein said web portion of said rigid member is connected to and extends from a upright side edge of one of said flanges of said second socket, said second socket being sized to receive said second edge of said second structural member therein.

2. The apparatus of claim 1 wherein said c-shaped channels extend perpendicularly to a longitudinal axis of said rigid member.

3. The apparatus of claim 1 wherein said openings of said c-shaped channels are in opposite directions to each other.

4. The apparatus of claim 1 wherein said openings of said c-shaped channels are angularly oriented relative to said rigid member.

5. The apparatus of claim 1 wherein other of said pair of opposed flanges is selectably deformable so as to open said c-shaped channel.

6. The apparatus of claim 5 wherein said c-shaped channels include at least one fastener bore, sized to pass a fastener therethrough so as to secure said c-shaped channel to said structural member.

7. The apparatus of claim 1 wherein said first and second sockets are rigidly affixed to said rigid member.

8. The apparatus of claim 1 wherein said first and second sockets are integrally formed with said rigid member.

9. The apparatus of claim 1 wherein said rigid member and said first and second sockets are formed of metal.

10. The apparatus of claim 1 wherein said rigid member comprises an elongate beam.

11. The apparatus of claim 10 wherein said beam is selected from the group consisting of a tube, a box section, an I-beam, a c-shaped channel, an L-shaped channel and a triangular cross section beam.

12. The apparatus of claim 1 further comprising a pair of intersecting rigid member each sized to extend between top and bottom edges of opposed parallel structural members, each of said rigid members having a first socket sized to receive a top edge of one of said pair structural members therein and a second socket sized to receive a bottom edge of said other of said pair of structural members therein.

13. The apparatus of claim 12 wherein said pair of intersecting rigid members are pivotally connected to each other.

14. The apparatus of claim 13 wherein said pair of intersecting rigid members are pivotally connected to each other by a bolt.

15. A method for reinforcing adjacent parallel spaced apart wooden structural members, each of said structural members having opposed first and second edges, the method comprising:

locating a first structural member in a desired position;

engaging said first socket of a reinforcing device around said first edge of said first structural member said first socket comprising a downwardly opening c-shaped channel formed of a pair of opposed flanges and a web portion therebetween; and locating a second structural member in a desired position with said second edge of said second structural member within a second socket of said reinforcing device said second socket comprising an upwardly opening c-shaped channel formed of a pair of opposed flanges and a web portion therebetween, said reinforcing member having a rigid member extending between and connected to an upright side edge of one of said flanges of each of said first and second sockets such that said first and second sockets are connected to a vertical web portion of said rigid member.

16. A method for reinforcing adjacent parallel spaced apart wooden structural members, each of said structural members having opposed first and second edges, the method comprising:

locating a first structural member in a desired position;

locating a second structural member in a desired position; and rotating a reinforcing device between said first and second structural members until a first socket at a first end of the reinforcing device is engaged around a second edge of said first structural member and a second socket at a second end of the reinforcing device is engaged around a first edge of said second structural member, wherein said first and second sockets comprise downwardly opening c-shaped channels formed of a pair of opposed flanges and a web portion therebetween said reinforcing device having an upright web portion connected to and extending from a vertical side edge of one of said flanges of said first and second sockets.

* * * * *